US008602749B2

(12) United States Patent
Zwickler et al.

(10) Patent No.: US 8,602,749 B2
(45) Date of Patent: Dec. 10, 2013

(54) VARIABLE DISPLACEMENT VANE PUMP

(75) Inventors: Georg Zwickler, Taunusstein (DE); Herbert Schmitz, Wiesbaden (DE)

(73) Assignee: GM Global Technology Operations LLC, Detroit, MI (US)

( * ) Notice: Subject to any disclaimer, the term of this patent is extended or adjusted under 35 U.S.C. 154(b) by 418 days.

(21) Appl. No.: 12/773,631

(22) Filed: May 4, 2010

(65) Prior Publication Data

US 2010/0282204 A1 Nov. 11, 2010

(30) Foreign Application Priority Data

May 5, 2009 (GB) ..... 0907687.8

(51) Int. Cl.
*F04B 1/02* (2006.01)
*F01C 20/22* (2006.01)
*F01C 1/30* (2006.01)

(52) U.S. Cl.
USPC ..... 417/220; 418/26; 418/27

(58) Field of Classification Search
USPC ..... 417/220, 228, 366; 418/26–29, 259, 418/102, 30, 31
See application file for complete search history.

(56) References Cited

U.S. PATENT DOCUMENTS

| | | | | |
|---|---|---|---|---|
| 2,669,189 | A | 2/1954 | Lancey et al. | |
| 5,090,881 | A * | 2/1992 | Suzuki et al. | 418/26 |
| 5,752,815 | A * | 5/1998 | Muller | 418/26 |
| 6,457,946 | B2 * | 10/2002 | Gretzschel et al. | 417/220 |
| 6,763,797 | B1 | 7/2004 | Staley et al. | |
| 2008/0175724 | A1 | 7/2008 | Shulver et al. | |
| 2008/0308062 | A1 * | 12/2008 | Morita et al. | 123/196 R |

FOREIGN PATENT DOCUMENTS

| | | | |
|---|---|---|---|
| DE | 102006061326 | A1 | 7/2008 |
| EP | 1486208 | B1 | 9/2006 |
| EP | 2065561 | A2 | 6/2009 |
| GB | 2305218 | A | 4/1997 |
| JP | 2009092051 | A | 4/2009 |
| WO | 03069127 | A1 | 8/2003 |

* cited by examiner

*Primary Examiner* — Peter J Bertheaud
*Assistant Examiner* — Dominick L Plakkoottam
(74) *Attorney, Agent, or Firm* — Ingrassia Fisher & Lorenz, P.C.

(57) ABSTRACT

A variable displacement vane pump includes, but is not limited to inlet and outlet ports in a pump body, a drive shaft rotatably mounted in the pump body, a rotor driven by the drive shaft and radially extending vanes slidably disposed in the rotor. A slide is pivotally disposed on a pivot and has a central axis eccentric to the axis of the rotor. Chambers are defined by the rotor, the vanes and the slide that are successively connected to the inlet and outlet ports. A resilient member is pivotally engaged with the slide and acts on the slide to urge the slide in one direction.

9 Claims, 7 Drawing Sheets

VARIABLE DISPLACEMENT VANE PUMP

CROSS-REFERENCE TO RELATED APPLICATION

This application claims priority to British Patent Application No. 0907687.8, filed May 5, 2009, which is incorporated herein by reference in its entirety.

TECHNICAL FIELD

The present invention relates to a variable displacement vane pump and, in particular, to a variable displacement vane pump of an engine lubrication system of an automotive vehicle.

BACKGROUND

The lubrication system of an engine pressurizes and distributes lubrication fluid, e.g. oil, to the engine lubrication circuits by use of a pump such as a variable displacement vane pump (VDVP). A variable displacement sliding vane pump may employ a rotor and a slide with multiple radially extending slidable vanes and cavities which can vary the volume of fluid delivered to the lubrication circuits. The slide is eccentrically offset from the rotor to create fluid chambers defined by the vanes, rotor and inner surface of the slide. A compression spring positions the slide to create large fluid chambers as the default.

When the engine requires less volume of fluid or less oil pressure by the pump, a pressure regulator directs fluid from the pump output line to a regulating chamber in the pump. Pressure in the regulating chamber pivots the slide against the force of the spring to more closely align the centers of the rotor and slide, thereby reducing the size of the fluid chambers. This reduces the amount of fluid drawn into the pump from the fluid reservoir and likewise, the amount of fluid output by the pump and thereby reduces the oil pressure as well.

U.S. Pat. No. 6,763,797 discloses a variable displacement pump in which pump outlet pressure is used to bias the position of a slide (also referred to as a cam ring), thereby changing the eccentricity of the slide with respect to the rotor axis and consequently varying the pump displacement. By varying the pump displacement relative to pump outlet pressure, the pump outlet pressure can be controlled based on engine flow requirements. The pressure regulation characteristics of the pump are determined by calibrating a reaction spring that counterbalances the hydraulic forces acting on the slide.

However, further improvements to variable displacement vane pumps and, in particular, variable displacement vane pumps with a pivotable slide for use in engine lubrication systems are desirable. In addition, other improvements, desirable features and characteristics are desirable and will become apparent from the subsequent summary and detailed description, and the appended claims, taken in conjunction with the accompanying drawings and this background.

SUMMARY

Embodiments of the present invention provide a variable displacement vane pump with a pivotable slide in which a resilient member urged against the slide is pivotally engaged with the slide.

The pivotable engagement between the resilient member and the slide is used to reduce the stress on the resilient member when the slide pivots against the resilient member and reduce the occurrence of bending and buckling of the resilient member. Consequently, the durability of the spring and the variable displacement vane pump can be increased. Furthermore, the occurrence of buckling due to the increased wear on the spring as a result of its installation may be reduced. Since the spring rate can be increased, fuel consumption should be able to be reduced as well.

The variable displacement vane pump may comprise the following; a pump body, inlet and outlet ports in said pump body, a drive shaft rotatably mounted in said pump body, a rotor driven by said drive shaft and a plurality of radially extending vanes slidably disposed in said rotor. The variable displacement vane pump may also comprise a pivot disposed in said pump body, a slide pivotally disposed on said pivot and having a central axis eccentric to the axis of said rotor and a plurality of fluid chambers defined by said rotor, said vanes and said slide that are successively connected to said inlet and outlet ports. A resilient member acts on said slide to urge said slide in one direction and a pressure control chamber is disposed between said pump body and an outer surface of said slide. As mentioned above, the resilient member is pivotally engaged with the slide.

In an embodiment, the resilient member is biased between the pump body and the slide to urge the slide in one direction. The resilient member may be biased as to urge the slide into an end position of its pivotable range. In one embodiment, the resilient member is biased between the pump body and a tab protruding from the outer surface of the slide.

In one embodiment, the resilient member is pivoted about a pivot at the pump body upon pivoting of the slide against the resilient member.

The resilient member may comprise a spring such as a solenoid-wound spring which has a longitudinal axis.

The spring may further comprise a seat in pivotable engagement with the slide. The seat may also be in slidable engagement with the slide.

In one embodiment, the seat comprises a convex outer surface in slidable engagement with a concave surface positioned on the slide. The convex outer surface of the seat and the concave surface of the slide may be in form-locking engagement with one another.

In one embodiment, the seat further includes a guiding pin extending from a flat inner surface opposing said convex surface. The guiding pin is accommodated within said spring. The guiding pin may have a longitudinal axis which extends generally parallel to or along the longitudinal axis of the solenoid spring if the resilient member comprises a solenoid spring. The flat inner surface of the seat may be generally perpendicular to the longitudinal axis of the spring and the longitudinal axis of the guiding pin. The guiding pin may have a length which is less than the length of the uncompressed spring so as to allow the spring to be compressed by the slide when in the mounted condition.

In an embodiment, the spring is biased against the flat inner surface of the seat and urges the seat against the slide. If the seat has an outer convex surface, this outer convex surface may be urged against a concave surface positioned on the slide by the spring which is biased against the flat inner surface of the seat.

In an embodiment, the longitudinal axis of the spring is pivoted about a point at the pump body upon pivoting of the slide against the seat.

In a further embodiment, the outer surface of the seat slidably engages with the slide as the longitudinal axis of the spring is pivoted about a point on the pump body due to the pivoting of the slide against the seat. This sliding engagement between the seat of the spring and the slide enables the flat inner surface of the seat to be orientated in a more perpendicular fashion with respect to the longitudinal axis of the spring and be orientated in a more parallel fashion with the respect to the end face of the spring than in an arrangement in which no slidable engagement is provided between spring and slide. This further reduces the stress on the spring and may lead to an increase in the durability of the spring and the pump.

A lubrication system of an engine of an automotive vehicle is also provided which comprises a variable displacement vane pump according to one of the previous embodiments. The lubrication medium pumped by the pump may be oil.

However, the variable displacement vane pump according to one of the previous embodiments is not limited to use in lubrication systems of automotive vehicle engines but can also be used to pump other types of liquids or gases, for example, air in other applications.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
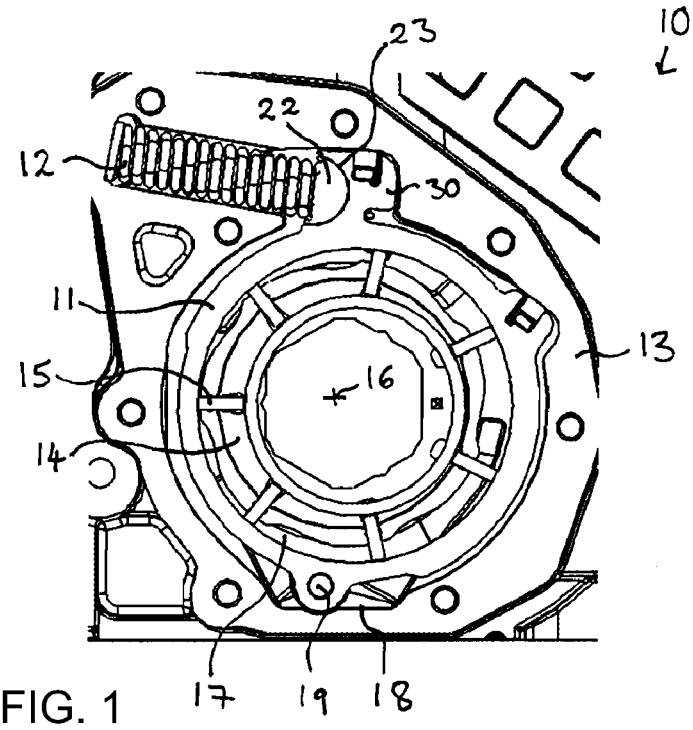
FIG. 1 illustrates a cross-sectional view of a variable displacement vane pump according to an embodiment of the present invention.
Figure 2:
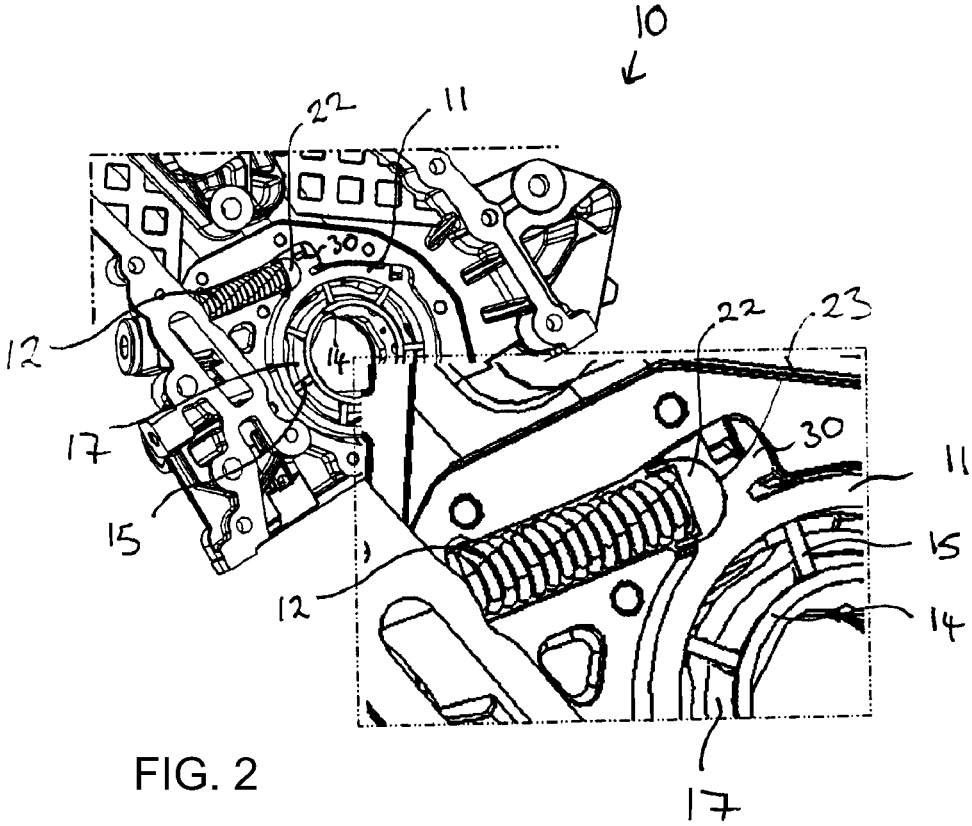
FIG. 2 illustrates a three-dimensional view of a portion of the variable displacement vane pump of FIG. 1.
Figure 3:
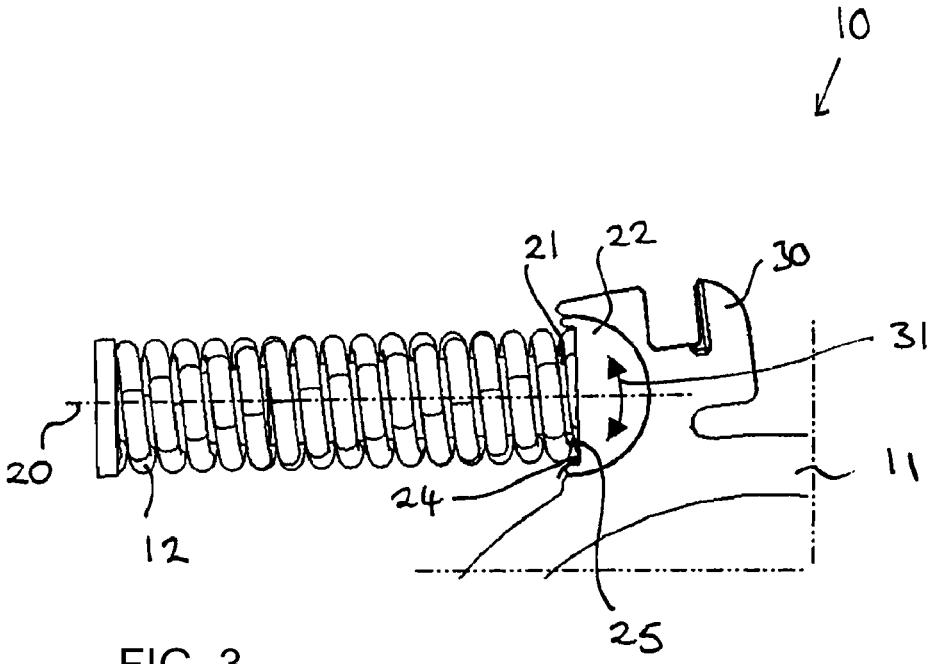
FIG. 3 illustrates a detailed view of the pivotable spring of the variable displacement vane pump of FIG. 1.

FIG. 1 illustrates a cross-sectional view of a variable displacement vane pump 10 according to an embodiment of the present invention. The variable displacement vane pump 10 includes a pivotable slide 11 which is urged in one direction by a resilient member in the form of a solenoid spring 12. A three-dimensional view of the spring 12 and slide 11 is illustrated in FIG. 2 and the movement of the spring 12 with respect to the slide 11 is illustrated in FIG. 3.

The variable displacement vane pump 10 may be used to supply lubrication medium to the lubrication system of an internal combustion engine. However, the variable displacement vane pump 10 is not limited to this use and may be used to pump other liquids or gases, for example, air in other applications.

The variable displacement vane pump 10 includes a housing 13. A rotor 14 having a plurality of radially extending slidable vanes 15 is rotatable in the housing 13 on a fixed axis 16. The rotor 14 may be driven by a cross-axis hex shaft drive of the engine or other suitable driving means powered by the engine. The slidable vanes 15 internally engage the slide 11 to define pumping chambers 17 within the slide 11.

The slide 11 is pivotally connected to the housing wall 18 by a pivot 19 and is pivotable about pivot 19 in the plane of the slide 11 to vary the displacement of the pumping chambers 17 by moving the position of the slidable vanes 15. The displacement of the pump 10 is proportional to the eccentricity of the slide 11 relative to the axis 16 of the rotor 14.

When the pump 10 is at rest, the slide 11 is urged by the spring 12 into a position of maximum eccentricity relative to the rotor 14. When the pump operates with the slide 11 in this position, the displacement of the pump is at its maximum value. As the slide 11 pivots away from a position of maximum eccentricity, indicated by arrow 29 in the drawings, the displacement of the pump is reduced and the output flow of the pump generally decreases. When the center of the slide 11 is pivoted to a position at which it is aligned with the axis 16 of the rotor 14, the slide 11 is at approximately 0% eccentricity (i.e., approximately 100% from its maximum eccentricity) and the pump 10 operates at zero displacement.

A non-illustrated oil inlet port is formed on an inlet side of the housing 13 and a non-illustrated pressurized oil outlet port is formed on an opposite outlet side of the housing 13. The inlet and outlet ports communicate with the pumping chambers 17 preferably on opposite bottom and top sides of the rotor 14 in order to prevent entrapment of gases in the pumping chambers 17. Rotation of the rotor 14 at some level of eccentricity causes the pumping chambers 17 to expand. This change in chamber volume in turn causes a decompression of the pumping chambers which causes oil to be sucked into the pumping chambers 17 through the inlet port and then pushed out of the pumping chambers 17 through the outlet port as the chambers contract.

The spring 12 is a solenoid-wound spring having a longitudinal axis 20. The spring 12 is biased between the pump housing 13 and the slide 11, in particular a tab 30 extending from the outer surface of the slide 11. The spring is accommodated within a generally tubular cut out in the housing 13.

The resilient member comprises, in addition to the spring 12, a guiding pin 21 with an integral seat 22. The guiding pin 21 has a length which is less than that of the installed solenoid spring 12 and is positioned concentrically within the spring 12 so that it extends generally long the longitudinal axis 20 of the spring 12. The seat 22 has an outer convex surface 23 and a flat inner surface 24 opposing the outer convex surface 23. The flat inner surface 24 extends generally perpendicularly to the length of the guiding pin 21 and the longitudinal axis 20 of the spring 12. The end face 25 of the spring 12 is generally parallel to the flat surface 24 of the seat 22.

The outer convex surface 23 of the seat 22 is in slidable engagement with a concave surface 26 positioned in a surface of the tab 30 protruding from the outer surface of the pivotable slide 11. This sliding engagement is indicated in FIG. 3 by the arrow 31.

The guiding pin 21 and the spring 12 are pivotable about a pivot 27 positioned at the pump housing 13 so that the longitudinal axis 20 of the spring 12 has an excursion path due to the movement of the slide 11 against the spring 12.

Figure 4:
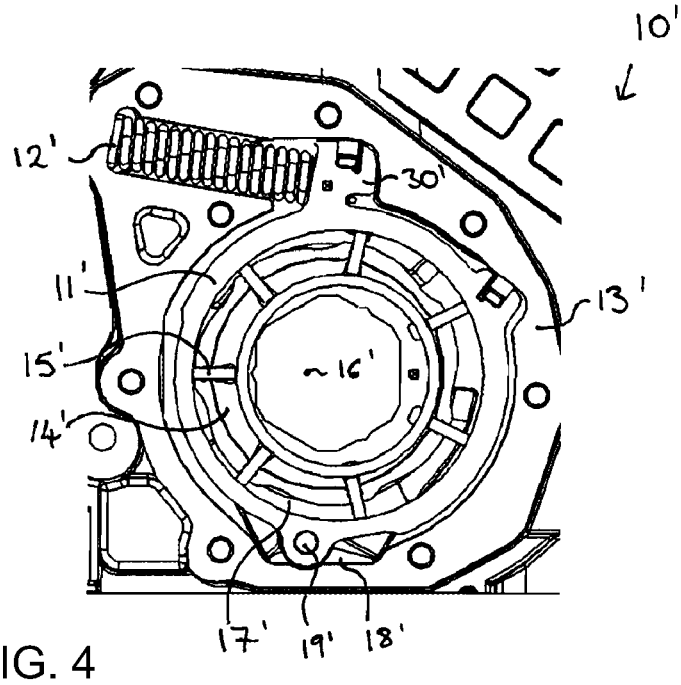
FIG. 4 illustrates a cross-sectional view of a comparison variable displacement vane pump.

FIG. 4 illustrates a cross-sectional view of a comparison variable displacement vane pump 10' with a pivotable slide 11'. In this comparison variable displacement vane pump 10' the resilient member comprises only a spring 12' which extends between a flat surface 26' of the tab 30' of the slide 11'. The flat surface 26' is generally perpendicular to the longitudinal axis 20' of the spring 12' and parallel to the end face 25' of the spring 12'.

Figure 5:
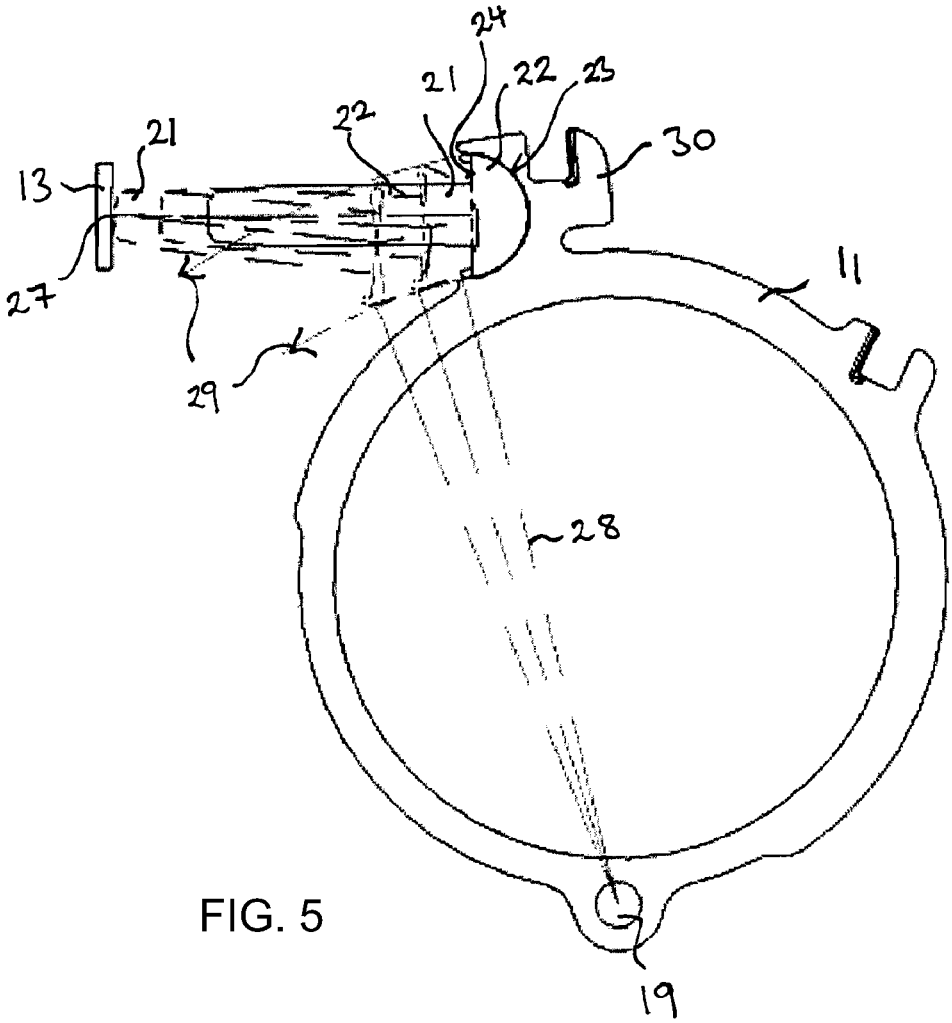
FIG. 5 illustrates the pivotable spring and slide of FIG. 1.
Figure 6:
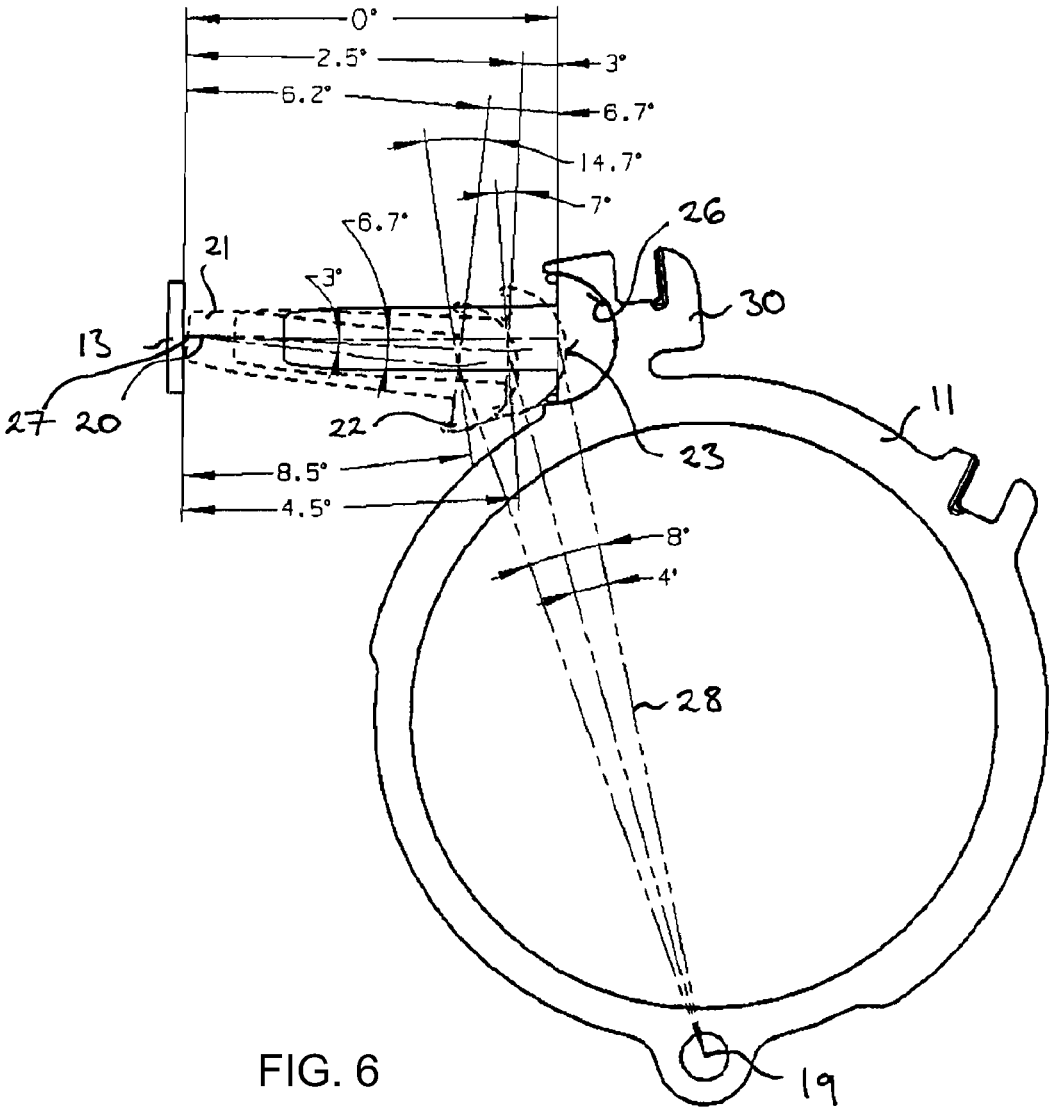
FIG. 6 illustrates the angular displacement of the pivotable spring and the slide of FIG. 5.
Figure 7:
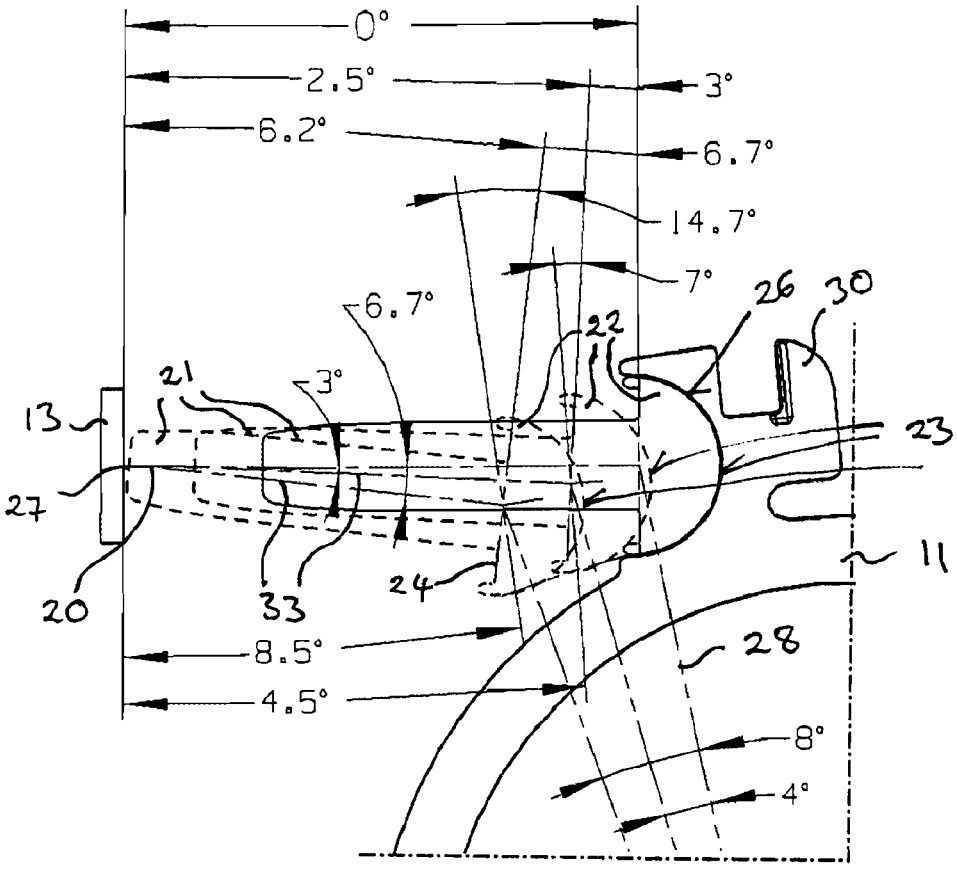
FIG. 7 illustrates a detailed view of the pivotable spring of FIG. 6.
Figure 8:
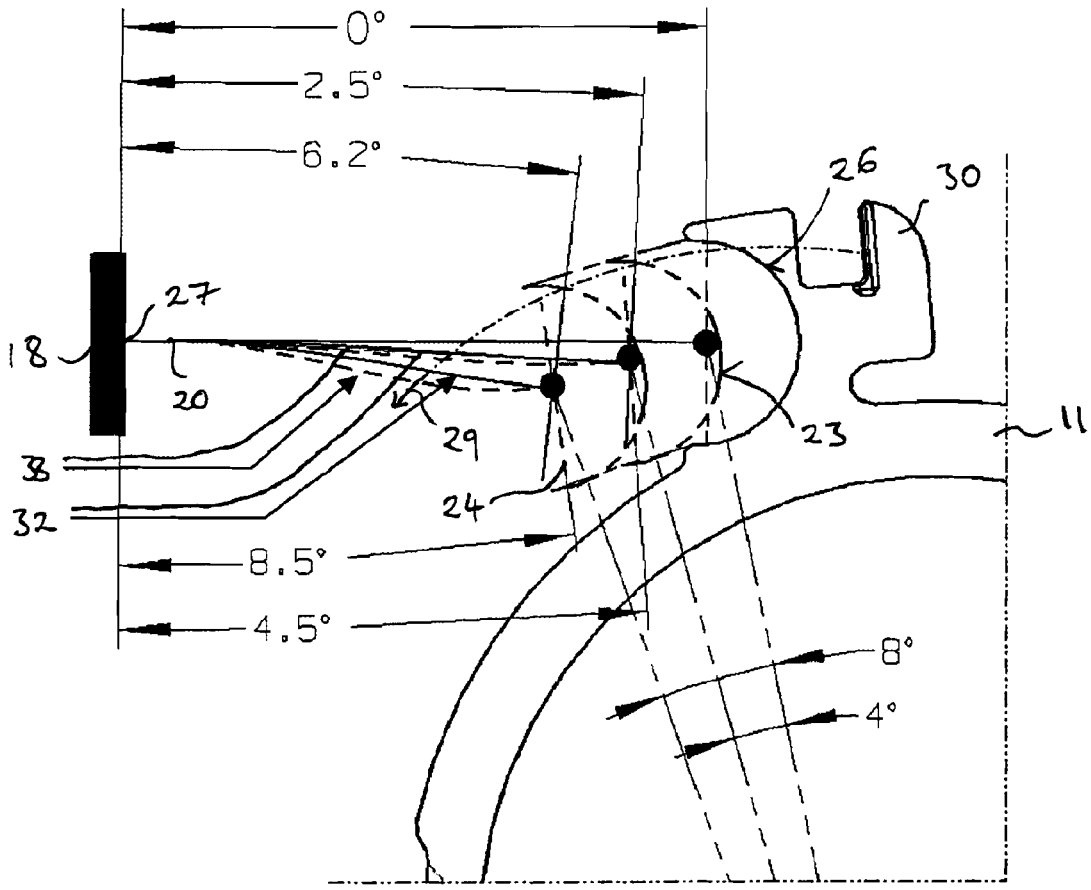
FIG. 8 illustrates a schematic view of the pivotable spring of FIG. 7.

FIG. 5 illustrates the operation of the spring 12 and pivotable slide 11 of the variable displacement pump illustrated in FIG. 1. Three positions of the spring 12 and slide 11 are illustrated in FIG. 5 and FIG. 6. The angular displacement of the spring 12 and the slide 11 about their respective pivot points 27; 19 are illustrated in FIG. 6, FIG. 7 and FIG. 8 for particular positions.

One end point of the pivotable range of the slide 11 is illustrated in the drawings by reference number 28. When the slide 11 is in end position 28, the guiding pin 21 and spring 12 are arranged so that their longitudinal axis 20 is generally perpendicular to the pump housing 13. The end position 28 may, typically, be defined as the position of the slide 11 at which the fluid chambers 17 have their largest volume.

As the slide 11 is pivoted anticlockwise about pivot 19 in the plane of the slide 11, the spring 12 is compressed and the concave surface 26 of the tab 30 slidably engages with the outer convex surface 23 of the seat 22 thus causing the guiding pin 21 and spring 12 to pivot clockwise about pivot point 27 at the pump housing 13. As the angular displacement of the slide 11 increases, i.e., the slide 11 pivots further in the anticlockwise direction, the guiding pin 21, seat 22 and spring 12 further pivots in the clockwise direction.

Due to the pivoting action of the guiding pin 21, the flat surface 24 of the seat 22 remains more parallel with respect to the end face 25 of the spring 12 and more perpendicular to the longitudinal axis 20 of the spring 12 than would be the case if the slidable arrangement of the seat 22 and tab 30 were omitted. This reduction in the change in the angle between the end face 25 of the spring 12 and the surface against which it is biased reduces the stress on the spring 12 so that the likelihood of the spring 12 buckling is reduced. The durability and lifetime of the spring 12 and the pump may be increased.

FIG. 6 to FIG. 8 illustrate two angular displacements of the slide 11 away from the end position 28 for the pump 10 of FIG. 1 provided with a pivotable spring 12. When the slide 11 is pivoted by 4° anticlockwise from the end position 28, the longitudinal axis 20 of the guiding pin 21 and spring 12 is caused to pivot approximately 3° in the clockwise direction. The flat surface 24 of the seat 22 is caused to pivot approximately 2.5° clockwise.

When the slide 11 is pivoted by approximately 8° anticlockwise from the end position 28, the longitudinal axis 20 of the guiding pin 21 and spring 12 caused to pivot approximately 6.7° in the clockwise direction. The flat surface 24 of the seat 22 is caused to pivot approximately 6.2° clockwise.

A comparison of the path of excursion for the spring 12 with a seat 22 at the slide side as well as for the spring 12' of the comparison pump 10' is illustrated in FIG. 8. The excursion for the spring 12 with a seat 22 at the slide side is indicated by the solid lines 32 and the excursion for a spring 12' in the comparison pump 10' of FIG. 4 is illustrated by dashed lines 33.

The excursion of the pivotable spring 12 with guiding pin and seat 22 is slidable engagement with the slide 11 is linear. In contrast, the spring 12' of the comparison pump 10' has a non-linear excursion with a maximum displacement region. Furthermore, the displacement of the spring 12' of the comparison pump 10' is greater that that of the spring 12 arrangement according to an embodiment of the present invention.

For the comparison pump 10' illustrated in FIG. 4, an angular displacement of the slide 11' of approximately 4° causes the longitudinal axis of the spring to be displaced by approximately 7° and the flat face of the seat is caused to pivot approximately 4.5° clockwise.

For a slide angular displacement of approximately 8°, the longitudinal axis of the spring is displaced by approximately 14.7° and the flat face of the seat is caused to pivot approximately 8.5° clockwise if the end face of the spring 12' engages with a non-slidable flat surface of the tab 30'. The spring 12' is subjected to greater stress than in the arrangement according to an embodiment of the present invention and buckling of the spring is more likely to occur as a result.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A variable displacement vane pump, comprising:

a pump body;

a drive shaft rotatably mounted in said pump body;

a rotor driven by said drive shaft;

a plurality of radially extending vanes slidably disposed in said rotor;

a pivot disposed in said pump body;

a slide pivotally disposed on said pivot and having a central axis eccentric to an axis of said rotor;

a plurality of fluid chambers defined by said rotor, said plurality of radially extending vanes and said slide; and a resilient member pivotally engaged with said slide and acting on said slide to urge said slide in one direction, wherein the resilient member is adapted to pivot about a second pivot at the pump body upon pivoting of the slide against the resilient member, wherein the resilient member comprises a solenoid spring having a longitudinal axis and comprising a seat in pivotable engagement with the slide, and wherein the seat comprises a convex outer surface in slidable engagement with a concave surface positioned on the slide with the convex and concave surfaces always in contact with each other for all phases of operation of the pump.

2. The variable displacement vane pump according to claim 1, wherein the resilient member is biased between the pump body and the slide.

3. The variable displacement vane pump according to claim 2, wherein the resilient member is biased between the pump body and a tab protruding from an outer surface of the slide.

4. The variable displacement vane pump according to claim 1, wherein the seat further comprises a guiding pin extending from a flat inner surface of the seat opposing said convex outer surface, said guiding pin being accommodated within said solenoid spring.

5. The variable displacement vane pump according to claim 4, wherein the flat inner surface of the seat is generally perpendicular to the longitudinal axis of the solenoid spring.

6. The variable displacement vane pump according to claim 4, wherein the solenoid spring is biased against the flat inner surface.

7. A lubrication system of an engine of an automotive vehicle comprising:

a variable displacement vane pump, said variable displacement vane pump comprising:

a pump body;

a drive shaft rotatably mounted in said pump body;

a rotor driven by said drive shaft;

a plurality of radially extending vanes slidably disposed in said rotor;

a pivot disposed in said pump body;

a slide pivotally disposed on said pivot and having a central axis eccentric to an axis of said rotor;

a plurality of fluid chambers defined by said rotor, said plurality of radially extending vanes and said slide; and a resilient member pivotally engaged with said slide and acting on said slide to urge said slide in one direction, wherein the resilient member is adapted to pivot about a second pivot at the pump body upon pivoting of the slide against the resilient member, wherein the resilient member comprises a solenoid spring having a longitudinal axis and comprising a seat in pivotable engagement with the slide, and wherein the seat comprises a convex outer surface in slidable engagement with a concave surface positioned on the slide with the convex and concave surfaces always in contact with each other for all phases of operation of the pump.

8. The lubrication system according to claim 7, wherein the resilient member is biased between the pump body and the slide.

9. The lubrication system according to claim 8, wherein the resilient member is biased between the pump body and a tab protruding from an outer surface of the slide.

* * * * *